US005381862A

United States Patent [19]

Szarka et al.

[11] Patent Number: 5,381,862

[45] Date of Patent: Jan. 17, 1995

[54] COILED TUBING OPERATED FULL OPENING COMPLETION TOOL SYSTEM

[75] Inventors: David D. Szarka, Duncan; Lee W. Stepp, Comanche, both of Okla.

[73] Assignee: Halliburton Company, Duncan, Okla.

[21] Appl. No.: 113,141

[22] Filed: Aug. 27, 1993

[51] Int. Cl.[6] ..... E21B 23/00

[52] U.S. Cl. ..... 166/212

[58] Field of Search ..... 166/212–217, 166/120, 125

[56] References Cited

U.S. PATENT DOCUMENTS

| | | | |
|---|---|---|---|
| 2,380,022 | 7/1945 | Burt | 166/1 |
| 2,435,016 | 1/1948 | Pitts | 166/1 |
| 2,471,382 | 5/1949 | Althouse, Jr. et al. | 166/1 |
| 2,667,926 | 2/1954 | Alexander | 166/1 |
| 2,672,199 | 3/1954 | McKenna | 166/191 |
| 2,723,677 | 11/1955 | Middleton et al. | 137/370 |
| 2,804,830 | 9/1957 | Garrett et al. | 103/233 |
| 2,832,422 | 4/1958 | Cross, Jr. et al. | 166/216 |
| 2,924,278 | 2/1960 | Garrett et al. | 166/214 |
| 2,965,177 | 12/1960 | Le Bus, Sr. et al. | 166/240 |
| 3,006,374 | 10/1961 | Prachner | 166/332 X |
| 3,051,243 | 8/1962 | Grimmer et al. | 166/224 |
| 3,051,244 | 8/1962 | Litchfield | 166/225 |
| 3,071,193 | 1/1963 | Raulins | 166/226 |
| 3,073,392 | 1/1963 | Dinning et al. | 166/224 |
| 3,115,188 | 12/1963 | Cochran et al. | 166/224 |
| 3,120,267 | 2/1964 | Bayless | 166/332 X |
| 3,151,681 | 10/1964 | Cochran | 166/224 |
| 3,223,160 | 12/1965 | Baker | 166/27 |
| 3,228,473 | 1/1966 | Baker | 166/154 |
| 3,247,905 | 4/1966 | Baker | 166/194 |
| 3,251,416 | 5/1966 | Kiel | 166/44 |
| 3,335,802 | 8/1967 | Seyffert, III | 166/226 |
| 3,355,142 | 11/1967 | Kammerer, Jr. et al. | 251/175 |
| 3,414,060 | 12/1968 | Zak | 166/332 X |
| 3,524,503 | 8/1970 | Baker | 166/289 |
| 3,705,624 | 12/1972 | Pitts | 166/216 |
| 3,760,878 | 9/1973 | Peevey | 166/185 |
| 3,768,556 | 10/1973 | Baker | 166/154 |
| 3,768,562 | 10/1973 | Baker | 166/289 |
| 3,789,926 | 2/1974 | Henley et al. | 166/224 R |
| 3,811,500 | 5/1974 | Morrisett et al. | 166/154 |
| 3,948,322 | 4/1976 | Baker | 166/289 |
| 4,083,401 | 4/1978 | Rankin | 166/332 X |
| 4,105,069 | 8/1978 | Baker | 166/332 X |
| 4,108,257 | 8/1978 | Sizer | 166/154 X |
| 4,278,131 | 7/1981 | Jani | 166/332 |
| 4,364,430 | 12/1982 | Szarka | 166/214 |
| 4,421,165 | 12/1983 | Szarka | 166/151 |
| 4,421,182 | 12/1983 | Moody et al. | 175/65 |
| 4,457,368 | 7/1984 | Knierimen et al. | 166/217 |
| 4,479,539 | 10/1984 | Tamplen et al. | 166/212 |
| 4,505,341 | 3/1985 | Moody et al. | 175/65 |
| 4,512,406 | 4/1985 | Vann et al. | 166/297 |
| 4,520,870 | 6/1985 | Pringle | 166/317 |
| 4,625,799 | 12/1986 | McCormick et al. | 166/223 |
| 4,678,035 | 7/1987 | Goldschild | 166/250 |
| 4,705,107 | 11/1987 | Council et al. | 166/170 |
| 4,781,250 | 11/1988 | McCormick et al. | 166/240 |
| 4,880,059 | 11/1989 | Brandell et al. | 166/332 |
| 4,928,772 | 5/1990 | Hopmann | 166/386 |
| 4,949,788 | 8/1990 | Szarka et al. | 166/285 |
| 4,979,561 | 12/1990 | Szarka | 166/240 |
| 4,991,653 | 2/1991 | Schwegman | 166/312 |
| 4,991,654 | 2/1991 | Brandell et al. | 166/332 |
| 5,029,644 | 7/1991 | Szarka et al. | 166/223 |
| 5,090,481 | 2/1992 | Pleasants et al. | 166/332 X |

*Primary Examiner*—Michael Powell Buiz

*Attorney, Agent, or Firm*—Stephen R. Christian; Neal R. Kennedy

[57] ABSTRACT

A coiled tubing operated full opening completion tool system for use in a well bore. The tool system comprises a completion tool, such as a casing valve, disposed in a well casing. The tool system further comprises a positioner tool for opening and closing a sliding sleeve in the casing valve. A hydraulically actuated operating cylinder section, including opening and closing cylinder sections, is used to actuate the positioner tool to open and close the casing valve sleeve. Hydraulic slips lock the tool in position in the well bore during actuation. The tool further comprises a jetting tool which is hydraulically actuated between an open position thereof in which fluid in the tool is communicated through a jetting nozzle aligned with a port in the casing tool and a closed position. A J-slot and lug are provided in the positioner tool for controlling the longitudinal position thereof during opening and closing of the casing valve sleeve. Another J-slot and lug are provided in the jetting tool for controlling the longitudinal position of a jetting sleeve therein for opening and closing the jetting tool. A spring in the jetting tool biases the jetting sleeve toward its closed position. The tool is specifically designed for, but not limited to, use on coiled tubing.

40 Claims, 8 Drawing Sheets

COILED TUBING OPERATED FULL OPENING COMPLETION TOOL SYSTEM

BACKGROUND OF THE INVENTION

1. Field Of The Invention

The present invention relates generally to completion tools or casing valves used in well bores, to positioning tools for positioning a sliding member in the completion tool, and to jetting tools for washing a casing bore by spraying fluid through a port in the completion tool. More particularly, the invention relates to a completion tool system with a hydraulically actuated positioning tool and with a jetting tool at the lower end thereof which can be opened and closed hydraulically.

2. Brief Description Of The Prior Art

It is known that sliding sleeve type casing valves or completion tools can be placed in the casing of a well to provide selective communication between the casing bore and subsurface formation adjacent to the casing valve. One such casing valve is shown in U.S. Pat. No. 4,991,654 to Brandell et al., assigned to the assignee of the present invention. The casing valve includes an outer housing with a sliding sleeve. First and second seals define a sealed annulus within the housing. A latch is disposed in the seal annulus for latching the sliding valve in its first and second positions. The housing has a plurality of housing ports defined therein, and the sliding sleeve has a plurality of sleeve ports defined therein. A third seal disposed between the sleeve and housing isolates all of the housing ports from all of the sleeve ports when the sleeve is in its first position relative to the housing. When the sleeve is moved to its second position relative to the housing, it is aligned so that the sleeve ports are in registry with the housing ports. This alignment is achieved by a lug and groove which are also disposed in the sealed annulus of the casing valve.

The sleeve in the casing valve of Brandell et al. is positioned by the positioning tool disclosed in U.S. Pat. No. 4,979,561 to Szarka, assigned to the assignee of the present invention. The positioning tool includes a drag assembly having a longitudinal passageway defined therethrough. An inner mandrel is disposed through the longitudinal passageway of the drag assembly and is longitudinally movable relative to the drag assembly.

Once the sliding sleeve in the casing valve is moved to its second position, fluid may be jetted through the jetting tool of Szarka et al. disclosed in U.S. Pat. No. 5,029,644, also assigned to the assignee of the present invention. The jetting tool is connected at a rotatable connection to the positioning tool. The jetting tool is thus rotatable relative to the positioning tool and the casing valve. The jetting tool hydraulically jets the casing valve as the jetting tool is rotated relative thereto.

In some instances, it is possible that the above-described prior art positioning tool can hang up in the casing string by inadvertently engaging recesses which exist in the casing string. Further, some auxiliary tools, such as retrievable bridge plugs have portions thereof, such as drag blocks, which may fall into the long gap of the sliding sleeve in prior art casing valves and hang up therein. Any of these hang-ups can cause damage to the positioning tool, casing valve and/or auxiliary tools.

The apparatus disclosed in U.S. Pat. No. 5,325,917 to Szarka, assigned to the assignee of the present invention provides a sliding sleeve in the casing valve with a selective latch profile. A positioning tool used with this valve has a positioner block with a corresponding latch profile so that the positioner block will latch only in the profile in the casing valve and not engage anything else in the casing string.

The apparatus of U.S. Pat. No. 5,325,917 works well, but is generally designed for use on a relatively rigid tool string where manipulation of the tool string is necessary to operate the positioning tool and thereby open and close the casing valve. Such a tool string will generally necessitate having a rig over the hole during the operation of the prior art apparatus. With the present invention, which is designed for operation with a coiled tubing unit, there is a great time savings generated over the prior art devices. Also, by using a coiled tubing unit, it may not be necessary to have a rig over the hole, and this results in a savings in expense to the well owner.

There may also be occasions when manipulation of the tool string is undesirable or difficult, such as in a deviated well. In such cases, it is often desirable to run tools into the well bore on a tubing string which is relatively more flexible than that of the prior art and which does not necessarily lend itself to precise positioning by reciprocal manipulation thereof in the well bore. The present invention solves this possible problem by providing a completion tool with a hydraulic cylinder section to actuate the positioning tool. The cylinder section may be operated by pressurizing and depressurizing the tubing string.

SUMMARY OF THE INVENTION

The present invention is a full opening completion tool system designed for operation with, but not limited to, coiled tubing. Generally, the tool system may be described as comprising a sliding sleeve casing tool apparatus or casing valve for use in a casing string of a well, a positioner tool apparatus for positioning a sliding member of the casing valve, an operating cylinder section for actuating the positioner tool in response to a fluid pressure, a hold-down section for holding the positioner tool in place during actuation thereof, and an apparatus for hydraulically jetting the casing valve.

The positioner tool and operating cylinder section together may be described as an apparatus for positioning a sliding member of a well tool and comprising an inner mandrel, operating means for selectively operably engaging the sliding member of the well tool in response to longitudinally reciprocating motion of the inner mandrel, and hydraulic actuating means for providing the reciprocating motion of the inner mandrel in response to a fluid pressure in the inner mandrel. The operating means comprises radially outwardly biased engagement means for automatically engaging the sliding member of the well tool when aligned therewith. The tool system further comprises hold-down means for lockingly engaging the well bore when the hydraulic actuating means is pressurized.

The hydraulic actuating means characterizes an embodiment of the operating cylinder section for providing upward and downward force on the inner mandrel. The operating cylinder section includes an opening cylinder for providing an upward force on the inner mandrel when pressure is applied to an opening cylinder and a closing cylinder section for providing a downward force on the inner mandrel when pressure is applied to a closing cylinder.

The engagement means comprises a plurality of positioner blocks circumferentially spaced about a longitudinal axis of the inner mandrel and having a radially outwardly facing engagement surface thereon, and biasing means for biasing the positioner blocks radially outwardly from the longitudinal axis. Each of the positioner blocks has a tapered locking surface defined on an end thereof. A locking means is provided for lockingly engaging the tapered locking surfaces and thereby locking the positioner blocks radially outwardly.

In the preferred embodiment, the plurality of positioner blocks is a first plurality of positioner blocks, and the positioning tool apparatus further comprises a second plurality of positioner blocks circumferentially spaced around the longitudinal axis and a second biasing means for resiliently biasing the second positioner blocks radially outwardly from the longitudinal axis. Each of the second positioner blocks has a radially outwardly facing engagement surface thereon.

In this embodiment, the locking means is connected to the inner mandrel and is adapted for locking the engagement means in operable engagement with the sliding member. The apparatus further comprises position control means, operably associated with the inner mandrel, for permitting the inner mandrel to reciprocate longitudinally and selectively lock and unlock the engagement means with the locking means in response to actuation by the hydraulic actuation means. The locking means includes upper and lower annular wedges having tapered annular locking surfaces thereon complementary to the locking surfaces of the first and second plurality of positioner blocks, respectively.

The position control means in the positioner tool comprises a J-slot defined in one of the inner mandrel and the operating means of the positioner tool, and a lug connected to the other of the inner mandrel and operating means. The lug is received in the J-slot.

The jetting tool may be described as an apparatus for hydraulically jetting a well tool, the well tool having a sliding member and defining a communication port through a side wall thereof. The jetting tool is attached to the positioner tool and provides non-rotational hydraulic jetting of fluid through the communication port.

The jetting tool comprises a jetting adapter defining a jetting port therein, a jetting sleeve slidably disposed in the jetting adapter and defining a sleeve central opening therethrough, and jetting operating means for longitudinally moving the jetting sleeve as pressure is applied thereto such that the jetting sleeve may be selectively moved between a closed position and an open position in which pressure in the sleeve central opening is in communication with the jetting port. A jetting nozzle may be placed in communication with the jetting port to jet fluid therefrom through the communication port in the well tool.

The jetting sleeve may define a sleeve port therethrough in communication with the sleeve central opening wherein the sleeve port is substantially aligned with the jetting port and jetting nozzle when the jetting sleeve is in the open position thereof.

The jetting sleeve in the jetting tool is actuated in response to pressure applied thereto such that it moves in one longitudinal direction, and the jetting tool preferably further comprises return means for biasing the jetting sleeve in an opposite direction. In the preferred embodiment, the sleeve moves downwardly in response to pressure and is biased upwardly by the return means.

The jetting operating means comprises a position control means for controlling the longitudinal position of the jetting sleeve as it is moved by pressure applied thereto or by force applied by the return means. This position control means comprises a J-slot defined in one of the jetting sleeve and the jetting adapter and a lug connected to the other of the jetting sleeve and jetting adapter. The J-slot includes positions corresponding to the open and closed positions of the jetting sleeve and further includes a blanked-off position in which the jetting sleeve is in another closed position, thereby preventing fluid pressure from bleeding through the jetting tool. This blanked-off position allows actuation of the positioner tool by the operating cylinder section.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIGS. 2A–2J show a cross-sectional view of a first embodiment of the casing tool system of the present invention. The valve sleeve in the casing valve is shown in an open position, and jetting ports in the jetting tool portion are aligned with the casing valve ports.

DESCRIPTION OF THE PREFERRED EMBODIMENT

Figure 1:
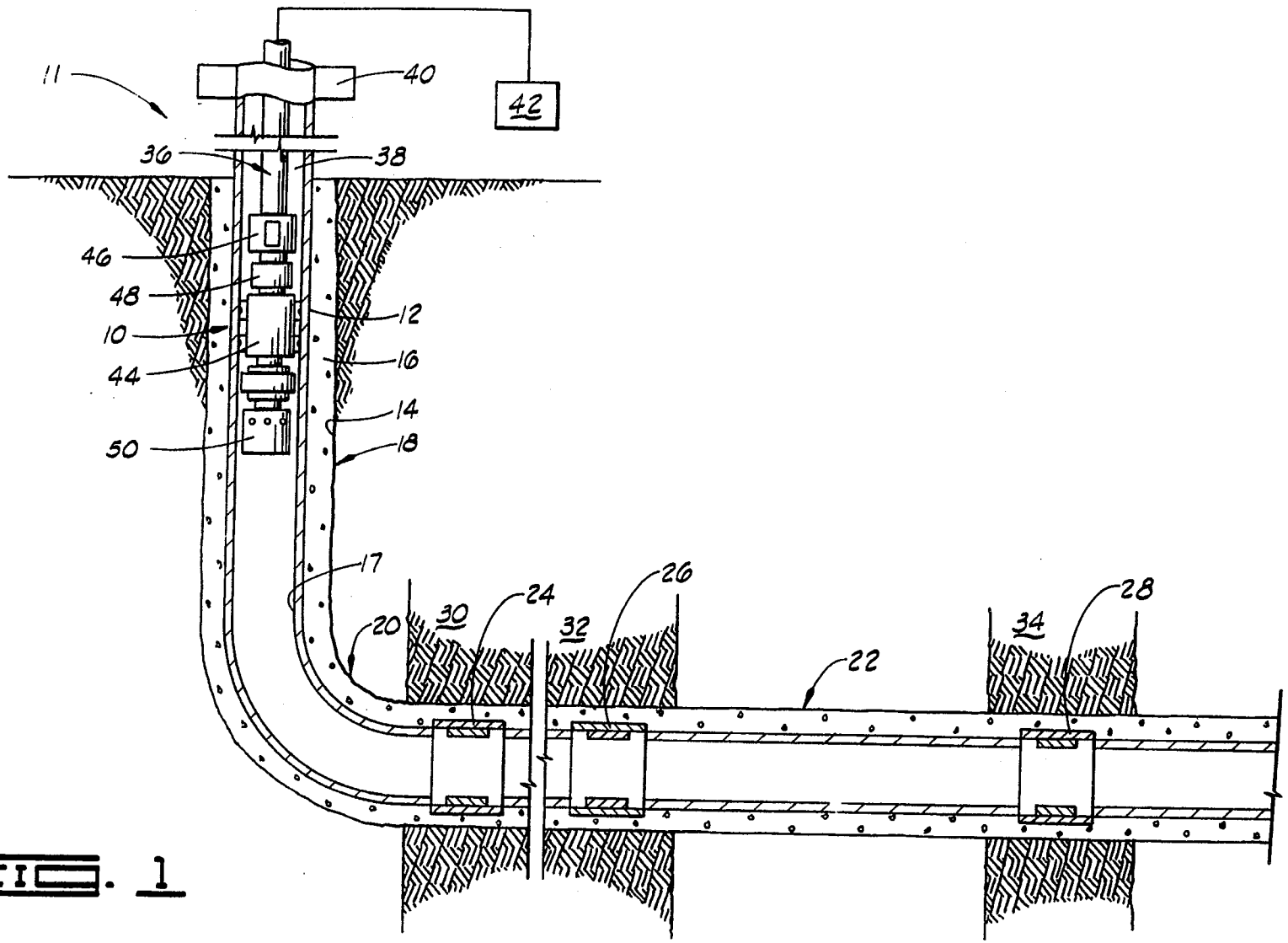
FIG. 1 is a schematic sectioned view of a well having a substantially deviated well portion. A work string is shown being run into the well including a positioner tool and a jetting tool. The deviated portion of the well is illustrated with multiple casing valves placed in the casing string.

Referring now to the drawings, and more particularly to FIG. 1, the coiled tubing operated full opening completion tool system of the present invention is shown and generally designated by the numeral 10. Completion tool system 10 is illustrated positioned in a well 11. Well 11 is constructed by placing a casing string 12 in a bore hole 14 and cementing the same in place with cement as indicated by numeral 16. The casing string may be in the form of a liner instead of the full casing string 12 illustrated. Casing string 12 has a casing bore 17 therein.

Well 11 has a substantially vertical portion 18, a radiused portion 20, and a substantially non-vertical deviated portion 22. Although the tools described herein are designed to be especially useful in the deviated portion of well 11, they can, of course, also be used in the vertical portion of the well.

Spaced along the deviated well portion 22 of casing 12 are a plurality of casing valves which are indicated by the numerals 24, 26 and 28. Casing valve 24, which is identical to casing valves 26 and 28, is shown in detail in FIGS. 2G–2I.

Each of casing valves 24, 26 and 28 is located adjacent to a subsurface zone or formation of interest, such as zones 30, 32 and 34, respectively.

In FIG. 1, a tubing string 36 having a plurality of tools connected to coiled tubing is shown being lowered into well casing 12. A well annulus 38 is defined between tubing string 36 and casing 12. A blowout preventer 40 located at the surface is provided to close well annulus 38. A pump 42 is connected to tubing string 36 for pumping fluid down the tubing string.

Referring now to FIGS. 2A–2J, the details of completion tool system 10 will be discussed. Generally, completion tool system 10 may be said to comprise casing valve 24 (and/or casing valves 26 and 28), a positioner tool 44, a hold-down section 46, an operating cylinder section 48 and a jetting tool 50.

Figure 2A:
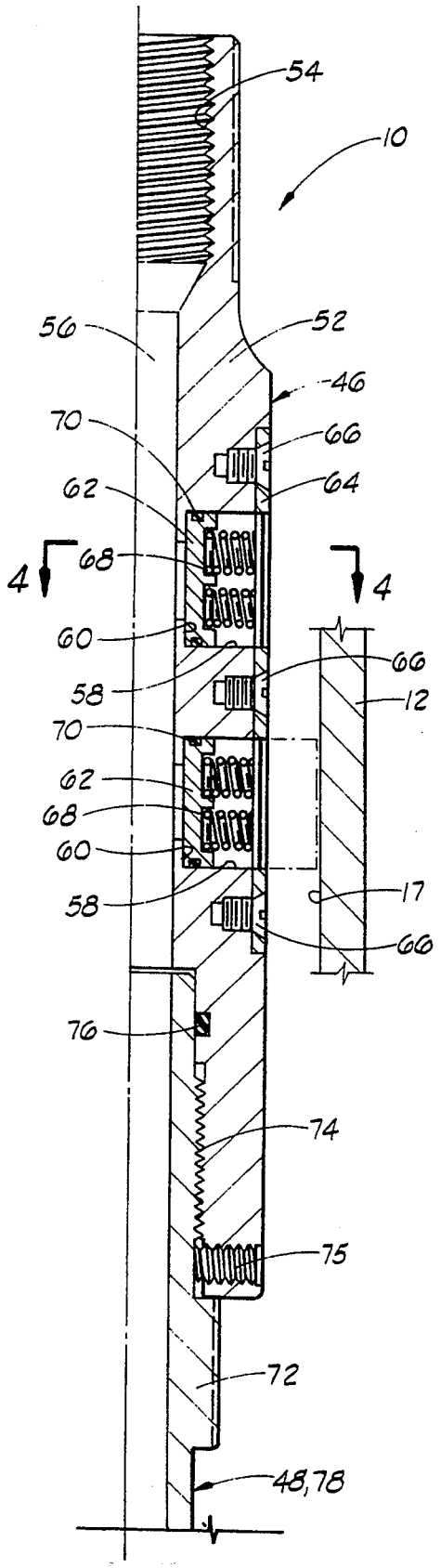

At the upper end of tool system 10 is hold-down section 46 which includes an adapter or body 52, as seen in FIG. 2A. At the upper end of adapter 52 is an internal thread 54 adapted for connection to tubing string 36. A central opening 56 is defined longitudinally in completion tool system 10.

Figure 4:
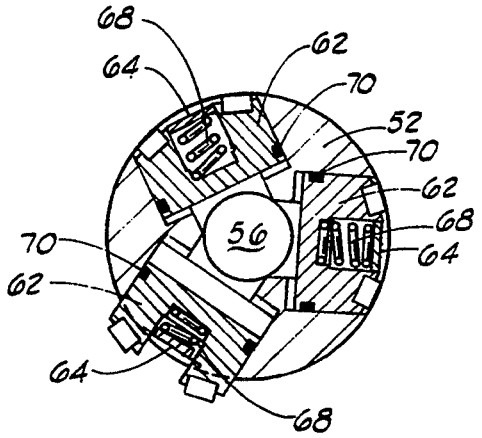
FIG. 4 shows a cross section taken along lines 4—4 in FIG. 2A.

Adapter 52 defines a plurality of openings 58 therein. Each opening 58 has a shoulder 60 at the inner end thereof. A hydraulic slip 62 is disposed in each opening 58 and held therein by a slip retainer 64 which is attached to adapter 52 by a plurality of fasteners, such as screws 66. A biasing means, such as a plurality of springs 68, biases slip 62 radially inwardly against shoulder 60. A sealing means, such as O-ring 70, provides sealing engagement between each slip 62 and adapter 52. See also FIG. 4.

As will be further described herein, hydraulic slips 62 are adapted for movement outwardly into locking engagement with casing bore 17 in valve casing 12 when pressure is applied to central opening 56 of apparatus 10.

Figure 3:
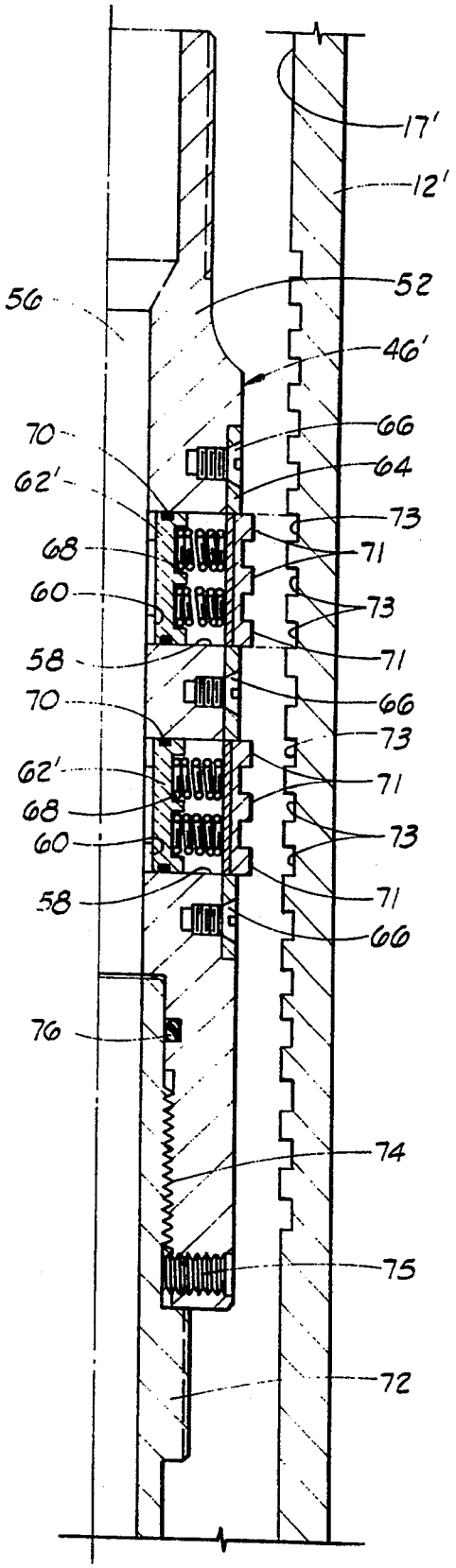
FIG. 3 illustrates an upper end of an alternate embodiment of the invention.

Referring now to FIG. 3, an alternate embodiment hold-down section 46′ is illustrated. The only difference between alternate embodiment hold-down 46′ and first hold-down section embodiment 46 is that in the alternate embodiment, slips 62′ have a plurality of radially outwardly extending lugs 71 thereon which are adapted to fit in a corresponding plurality of annular notches 73 defined in bore 17′ of casing 12′. It will be seen that this mortise and tenon type of engagement will result in a rigid locking of hold-down section 46′ into casing 12′ when slips 62′ are actuated.

In either embodiment, the lower end of adapter 52 is attached to upper piston sleeve 72 at threaded connection 74. A locking means, such as a set screw 75, may be used to prevent relative rotation between upper piston sleeve 72 and adapter 52. A sealing means, such as O-ring 76, provides sealing engagement between adapter 52 and upper piston sleeve 72.

Operating cylinder section 48 is seen in FIGS. 2A–2D and may be said to generally include an upper opening cylinder section 78 and a lower closing cylinder section 80. Upper piston sleeve 72 may be said to be a part of opening cylinder section 78.

Figure 2B:
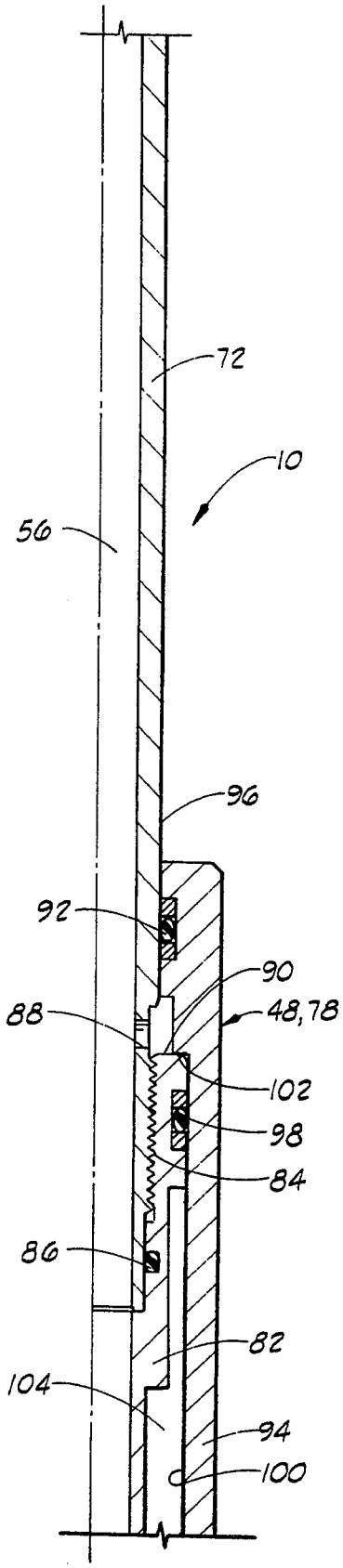

Referring now to FIG. 2B, the lower end of upper piston sleeve 72 is attached to an upper or opening piston 82 at threaded connection 84. Upper piston 82 is also a part of opening cylinder section 78. A sealing means, such as O-ring 86, provides sealing engagement between upper piston 82 and upper piston sleeve 72. A transverse sleeve port 88 is defined in upper piston sleeve 72 adjacent to upper end 90 of upper piston 82. It will be seen that sleeve port 88 provides communication between central opening 56 and upper end 90 of upper piston 82.

A sealing means, such as seal 92, provides sealing between the other main component of opening cylinder section 78, upper operating or opening cylinder 94, and outside diameter 96 of upper piston sleeve 72. As will be further discussed herein, upper piston sleeve 72 is adapted to slide within seal 92 and upper operating cylinder 94.

Another sealing means, such as seal 98, provides sealing engagement between upper piston 82 and bore 100 in upper operating cylinder 94.

A downwardly facing shoulder 102 in upper operating cylinder 94 limits upward movement of upper piston 82 within the upper operating cylinder.

Figure 2C:
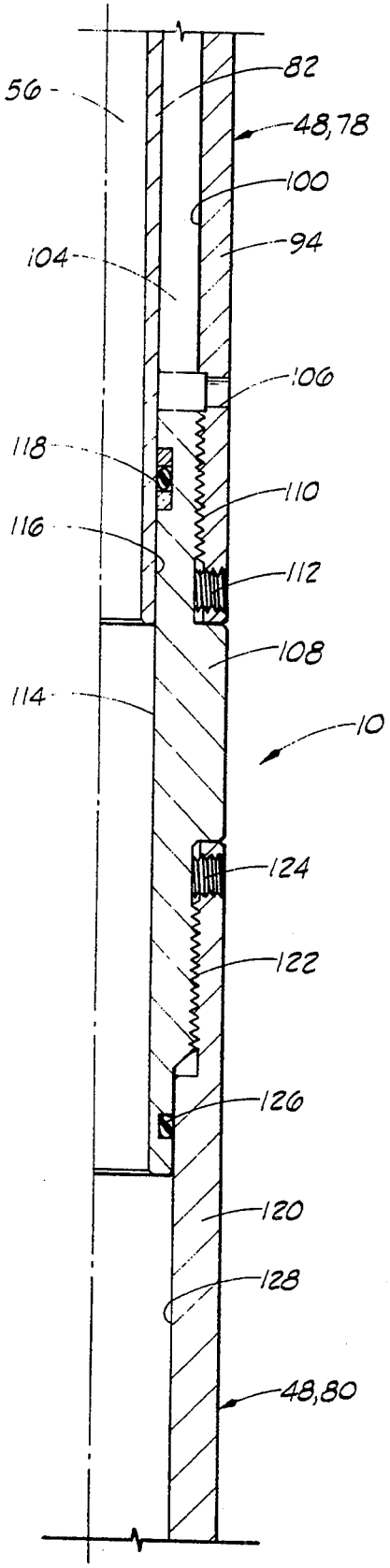

Referring now to FIG. 2C, an annular volume 104 is defined between upper operating cylinder 94 and upper piston 82. Adjacent to the lower end of annular volume 104, upper operating cylinder 94 defines a cylinder port 106 therethrough which provides communication between annular volume 104 and well annulus 38.

The lower end of upper operating cylinder 94 is attached to a cylinder adapter 108 at threaded connection 110. A locking means, such as set screw 112 prevents relative rotation therebetween.

Cylinder adapter 108 has a bore 114 therethrough which is adapted to slidingly receive a lower end of outside diameter 116 of upper piston 82. A sealing means, such as seal 118, provides sealing engagement between cylinder adapter 108 and the lower end of upper piston 82.

The lower end of cylinder adapter 108 is connected to a lower operating or closing cylinder 120 of closing cylinder section 80 at threaded connection 122. A locking means such as set screw 124 prevents relative rotation therebetween. A sealing means, such as O-ring 126, provides sealing engagement between the lower end of cylinder adapter 108 and lower operating cylinder 120.

Figure 2D:
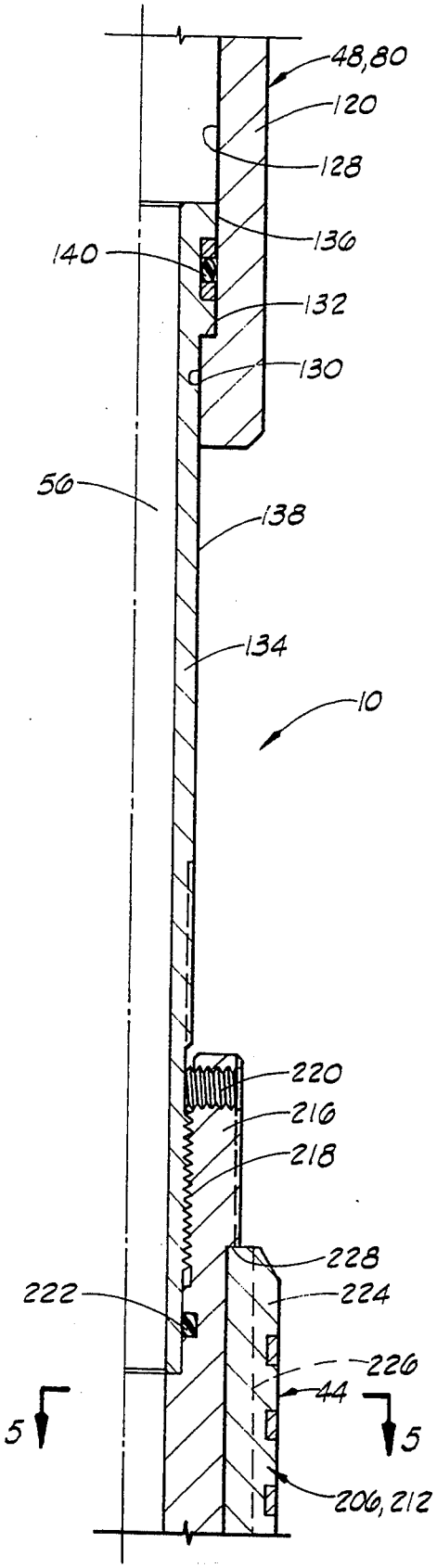

Referring now also to FIG. 2D, lower operating cylinder 120 defines a first bore 128 therein with a smaller, second bore 130 therebelow. An upwardly facing shoulder 132 extends between first bore 128 and second bore 130.

A lower or closing piston 134 has a first outside diameter 136 adapted for sliding within first bore 128 of lower operating cylinder 120 and a second outside diameter 138 which extends through second bore 130. A sealing means, such as seal 140, provides sealing engagement between lower piston 134 and first bore 128 in lower operating cylinder 120.

The lower end of lower piston 134 is connected to positioner tool 44 as will be further described herein.

Before discussing the details of positioning tool 44, it is important to have an understanding of casing valve 24. Casing valve 24, which may also generally be referred to as a sliding sleeve casing tool apparatus 24, is shown in detail in FIGS. 2G–2I. Casing valve 24 includes an outer housing or case 142 having a longitudinal passageway 144 defined therethrough and having a side wall 146 with a plurality of housing communication ports 148 defined through the side wall.

Upper and lower bodies 150 and 152 are attached to the upper and lower ends of housing 142, respectively, to facilitate handling and make-up of sliding sleeve casing tool 24 in the casing string 12. Upper body 150 has an internal thread 154 for connection to an upper portion of casing string 12, and lower body 152 has an external thread 156 for connection to a lower portion of casing string 12.

Casing valve 24 also includes a sliding sleeve 158 which comprises a collet sleeve 160 attached to a seal sleeve 162 at threaded connection 164. Sleeve 158 is disposed in longitudinal passageway 144 of housing 142 and is selectively movable relative to housing 142 between a first or closed position blocking or covering housing communication ports 148 and a second or open position shown in the drawings wherein housing communication ports 148 are uncovered and are communicated with longitudinal passageway 144, as will be further described herein.

Casing valve 24 also includes an upper wiper 166 which provides wiping engagement between collet sleeve 160 and housing 142. Casing valve 24 further includes spaced lower seals 168 and 170 which provide sealing engagement between seal sleeve 162 and housing 142. In the first position of sleeve 158, seals 168 and 170 are on longitudinally opposite sides of housing communication ports 148, thus sealingly separating ports 148 from longitudinal passageway 144. In the illustrated second position of sleeve 158, lower seals 168 and 170 are both above housing communication ports 148.

A position latching means 172 is provided for releasably latching sliding sleeve 158 in its first and second positions. Positioning latching means 172 is disposed in an annulus 174 defined between sliding sleeve 158 and housing 142. It will be seen that annulus 174 is protected between upper wiper 166 and lower seal 168.

Position latching means 172 includes a spring collet 176, which may also be referred to as a spring biased latch means 176. Spring collet 176 is longitudinally positioned between upper end 178 of seal sleeve 162 and downwardly facing shoulder 180 on collet sleeve 160. Thus, collet 176 moves longitudinally with sliding sleeve 158 and may be considered to be attached thereto.

Position latching means 172 also includes first and second radially inwardly facing longitudinally spaced grooves 182 and 184 defined in housing 142 and corresponding to first and second positions, relatively, of sliding sleeve 158.

By placing spring collet 176 in annulus 174, the collet is protected in that cement, sand and the like are prevented from packing around the collet and impeding its successful operation.

It is noted that position latching means 172 could also be constructed by providing a spring latch attached to housing 142 and providing first and second grooves in sliding sleeve 158 rather than vice versa as they have been illustrated.

Sliding sleeve 158 has a longitudinal sleeve bore 186 defined therethrough. Collet sleeve 160 of sliding sleeve 158 defines a first radially inwardly facing groove 188 in sleeve bore 186 with upper and lower chamfers 190 and 192 at the upper and lower ends of groove 188, respectively. See FIGS. 2G and 2H.

Figure 2E:
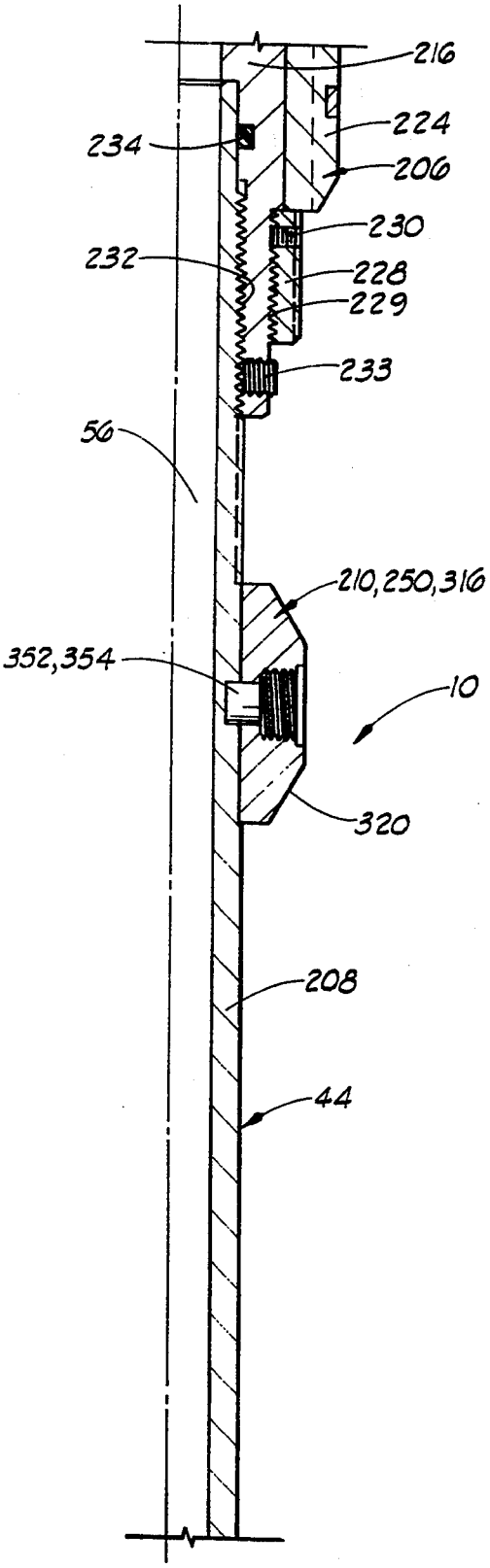
Figure 2F:
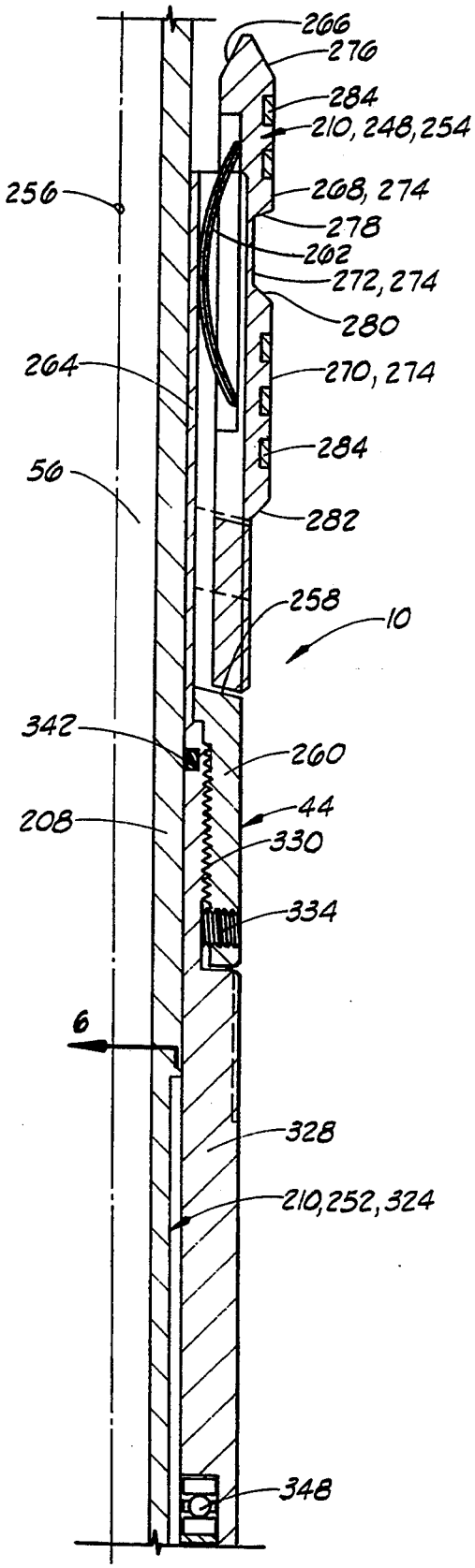
Figure 2G:
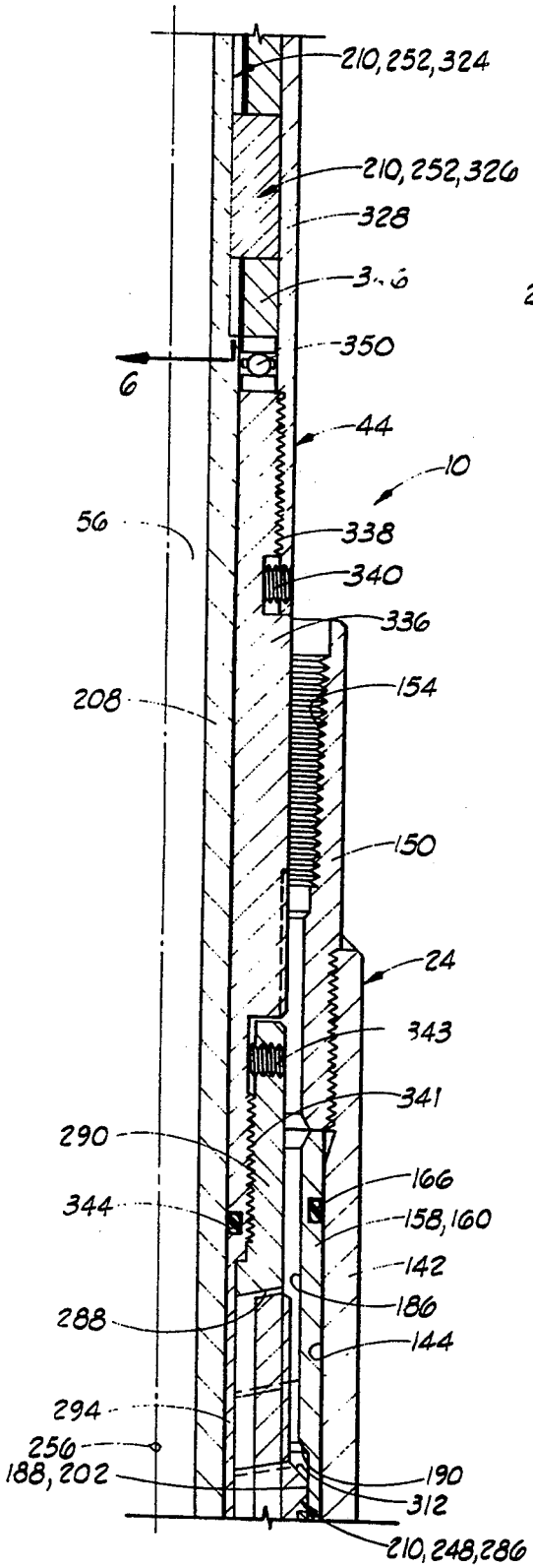
Figure 2H:
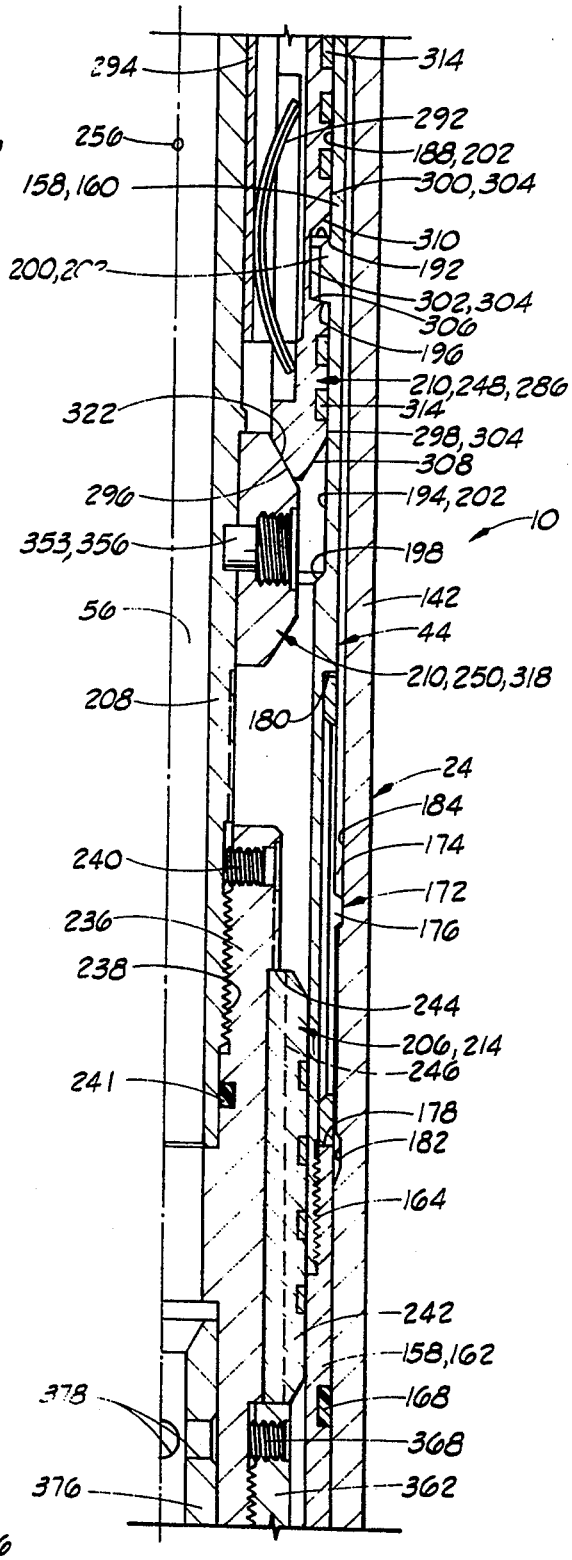
Figure 21:
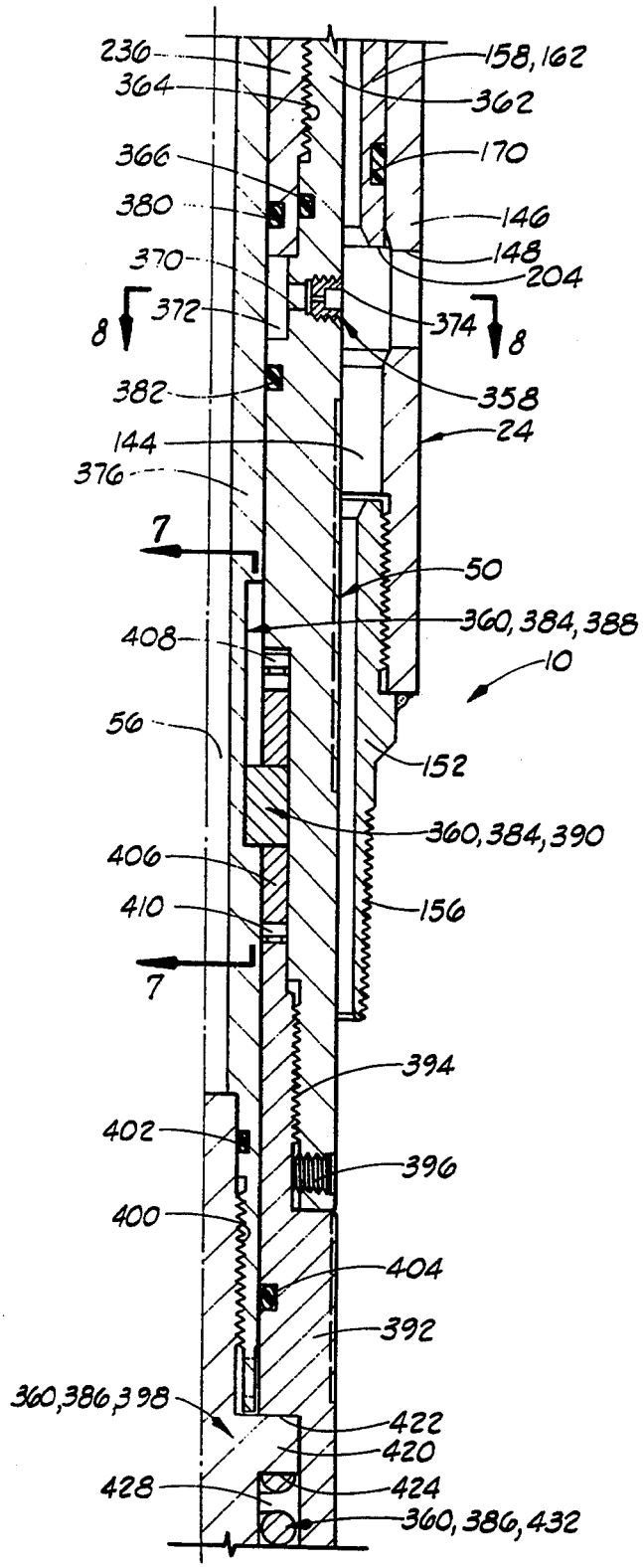
Figure 21:
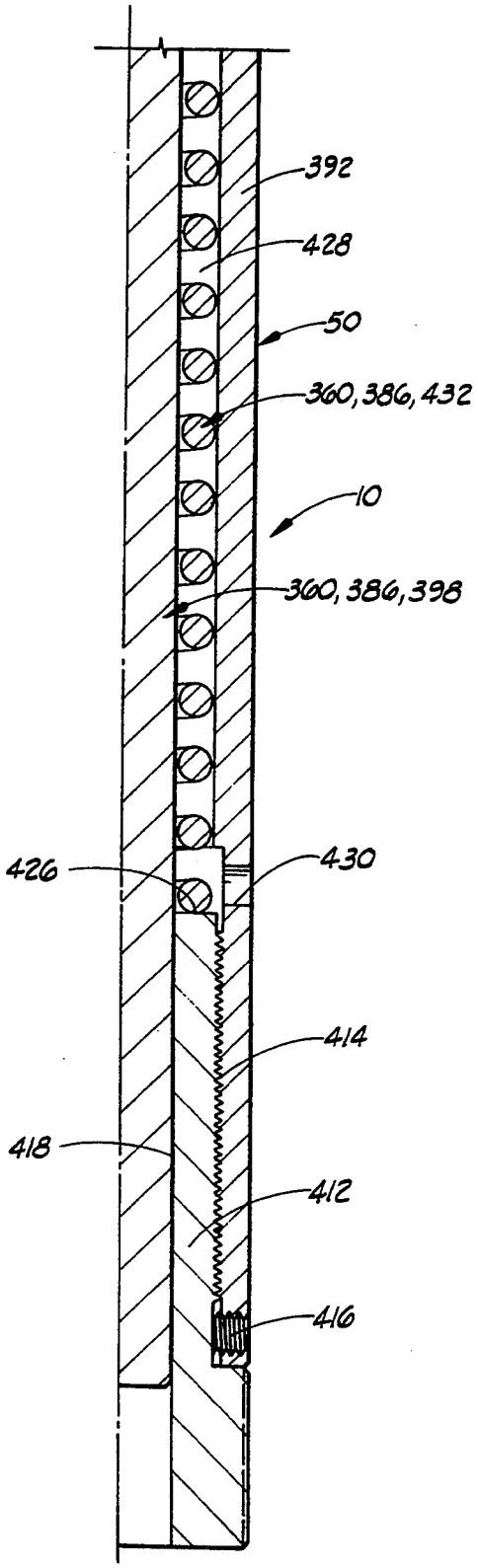

Spaced below first groove 188, collet sleeve 160 defines a second radially inwardly facing groove 194 therein having upper and lower chamfers 196 and 198 at the upper and lower ends thereof, respectively, as seen in FIG. 2H.

It may be said that first groove 188 and second groove 194 are separated by a ring or shoulder portion 200 in collet sleeve 160 of sliding sleeve 158.

First and second grooves 188 and 194 and ring 200 therebetween may be said to form a latch profile 202 adapted for engagement by positioning tool 44, as will be further described herein.

Sliding sleeve 158 has a lower end 204 which is the lower end of seal sleeve 162. End 204 is positioned adjacent to lower body 152 when sliding sleeve 158 is in the first position.

As previously indicated, sliding sleeve 158 is selectively movable relative to housing 142 between the first position and the second position shown in the drawings wherein lower end 204 of sliding sleeve 158 is positioned above housing communication ports 148 so that the ports are uncovered and in communication with longitudinal passageway 144.

The details of positioner tool 44, shown in FIGS. 2D–2H will now be discussed. Positioner tool 44 may be generally described as a positioning tool apparatus for positioning a sliding member of a well tool, such as sliding sleeve 158 of casing valve 24.

The primary components of positioner tool 44 are a guide means 206, an inner positioning mandrel 208 and an operating means 210.

Guide means 206 includes an upper guide assembly 212 shown in FIGS. 2D and 2E and a lower guide assembly 214 shown in FIG. 2H.

Upper guide assembly 212 includes an upper adapter 216 which is attached to the lower end of lower piston 134 at threaded connection 218. A set screw 220 may be used as a locking means for locking upper guide adapter 216 in place. A sealing means, such as O-ring 222, provides sealing between upper guide adapter 216 and lower piston 134.

Figure 5:
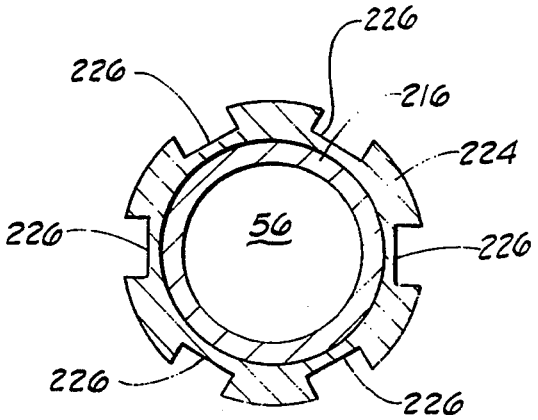
FIG. 5 is a cross section taken along lines 5—5 in FIG. 2D.

A star guide assembly 224, which has a plurality of flats 226, is disposed on upper guide adapter 216 adjacent to a shoulder 228 thereon. The general shape of star guide assembly 224 is best seen in FIG. 5.

Star guide assembly 224 is held in position by a star guide retainer 228 as seen in FIG. 2E. Star guide retainer 228 is attached to upper guide adapter 216 at threaded connection 229. A locking means, such as set screw 230, may be used to lock retainer 228 in place.

The upper end of inner positioning mandrel 208 is attached to upper guide adapter 216 at threaded connection 232 and locked in place by a locking means, such as set screw 233. A sealing means, such as O-ring 234, provides sealing engagement between star guide adapter 216 and inner positioning mandrel 208.

Lower guide assembly 214 of guide means 206 includes a lower guide adapter 236 attached to the lower end of inner positioning mandrel 208 at threaded connection 238. A locking means, such as set screw 240, locks mandrel 208 and lower guide adapter 236 together. A sealing means, such as O-ring 241, provides sealing engagement therebetween.

A star guide assembly 242 is disposed on lower guide adapter 236 adjacent to shoulder 244 thereon. Star guide assembly 242 is preferably substantially the same as star guide assembly 224 and has a plurality of flats 246 thereon.

Operating means 210 provides a means for selectively operably engaging sliding sleeve 158 of casing valve 24 in response to longitudinally reciprocating motion of inner positioning mandrel 208. More particularly, operating means 210 includes an engagement means 248 disposed on inner positioning mandrel 208 for operably engaging sliding sleeve 158 in casing valve 24. Operating means 210 also includes a locking means 250 connected to inner positioning mandrel 208 for locking engagement means 248 so that the engagement means is in operable engagement with sliding sleeve 158 of casing valve 24. Operating means 210 further includes a position control means 252 operably associated with engagement means 248 and inner positioning mandrel 208 for permitting the mandrel to reciprocate longitudinally relative to engagement means 248 and selectively lock and unlock engagement means 248 with locking means 250.

Engagement means 248 includes a first plurality of positioner blocks 254 circumferentially spaced around a longitudinal axis 256 of positioner tool 44 and inner positioning mandrel 208. Each positioner block 254 is disposed in a window 258 of a positioner body 260. A biasing means, such as a plurality of springs 262, biases each positioner block 254 radially outwardly. A spring sleeve 264 is disposed between inner mandrel 208 and springs 262 so that the springs do not drag on the inner mandrel.

At the upper end of each positioner block 254 is a tapered locking surface 266. Each positioner block 254 also has a first engagement surface 268 and a second engagement surface 270, spaced from first engagement surface 268, facing radially outwardly thereon. First and second engagement surfaces 268 and 270 are separated by a recess 272.

First and second engagement surfaces 268 and 270 and recess 272 may be said to form a selective latch profile 274 which is adapted for engagement with latch profile 202 in sliding sleeve 158 of casing valve 24, as will be further described herein.

A pair of chamfers 276 and 278 are located at opposite ends of first engagement surface 268, and similarly, chamfers 280 and 282 are located on opposite ends of second engagement surface 270.

Either or both of first and second engagement surfaces 268 and 270 may have hardened inserts 284 disposed therein.

Engagement means 248 further includes a second plurality of positioner blocks 286 similarly located around axis 256. Each positioner block 286 is disposed in a window 288 of a positioner body 290. In the preferred embodiment, positioner blocks 286 are identical to positioner blocks 254, and positioner body 290 is identical to positioner body 260. A biasing means, such as spring 292 engaging a spring sleeve 294, biases each positioner block 286 radially outwardly. The spring sleeve 294 is disposed between inner mandrel 208 and springs 292 so that the springs do not drag on the inner mandrel.

Each positioner block 286 has a locking surface 296 at one end thereof. Each positioner block 286 also has spaced first and second engagement surfaces 298 and 300, with second engagement surface 300 being longer than first engagement surface 298. A recess 302 separates first and second engagement surfaces 298 and 300.

First and second engagement surfaces 298 and 300 and recess 302 may be said to form a selective latch profile 304 which is adapted for engagement latch profile 202 in sliding sleeve 158 of casing valve 24.

A pair of chamfers 306 and 308 are located on opposite ends of first engagement surface 298, and similarly, a pair of chamfers 310 and 312 are located on opposite ends of second engagement surface 300.

One or more hardened inserts 314 may be disposed in either or both of first and second engagement surfaces 298 and 300.

Generally speaking, engagement means 248 may be said to include separate first and second engagement means, namely the first and second plurality of positioner blocks 254 and 286, respectively.

Locking means 250 comprises an upper annular wedge 316 and a lower annular wedge 318. Wedges 316 and 318 are substantially identical and may be symmetrical so that their orientation once positioned on inner positioning mandrel 208 is not critical.

Upper wedge 316 includes a tapered annular wedging surface 320 which is complementary to tapered locking surface 266 on positioner blocks 254. Upper wedge 316 is positioned on inner positioning mandrel 208 so that when the mandrel is moved downwardly using position control means 252, wedging surface 320 can be wedged against locking surface 266, thereby locking positioner blocks 254 in their radially outward position.

Lower wedge 318 has a similar annular wedging surface 322 which is complementary to locking surface 296 on positioner blocks 286, as seen in FIG. 2H, for locking positioner blocks 286 radially outwardly, as will be further described herein.

Position control means 252 includes a J-slot 324 defined in inner positioning mandrel 208, and a lug 326 connected to engagement means 248, with a lug being received in the J-slot. Generally speaking, J-slot 324 can be said to be defined in one of inner positioning mandrel 208 and engagement means 248, with the lug being connected to the other of inner positioning mandrel 208 and engagement means 248. J-slot 324 can be defined in engagement means 248, with the lug being connected to inner positioning mandrel 208.

The lower end of positioner body 260 is connected to an upper body 328 at threaded connection 330. Positioner body 260 may be locked to upper body 328 by a locking means, such as set screw 334. As seen in FIG. 2F, spring sleeve 264 forms an upper end of upper body 328.

The lower end of upper body 328 is attached to a lower body 336 at threaded connection 338, and a locking means, such as set screw 340, locks them together. As best seen in FIG. 2G, spring sleeve 294 forms a lower end of lower body 336.

The lower end of lower body 336 is attached to positioner body 290 at threaded connection 341. A locking means, such as set screw 343 locks lower body 336 and positioner body 290 together.

A backup seal 342 provides wiping engagement between upper body 328 and inner positioning mandrel 208, and a similar or identical backup seal 344 provides wiping engagement between lower body 336 and inner positioning mandrel 208.

It will thus be seen that J-slot lug 326 in the illustrated embodiment is generally connected to upper body 328. J-slot 324 is best seen in the laid-out view of FIG. 6 and is an endless J-slot.

Referring back to FIGS. 2F and 2G, lug 326 is mounted in a rotatable ring 346 sandwiched between upper body 328 and lower body 336 with bearings 348 and 350 being located at the upper and lower ends, respectively, of rotatable ring 346. This permits lug 326 to rotate relative to J-slot 324 as inner positioning mandrel 208 is reciprocated or moves longitudinally relative to engagement means 248 so that lug 326 may traverse the endless J-slot 324.

J-slot 324 and lug 326 of position control means 252 interconnect inner positioning mandrel 208 and engagement means 248 and define at least in part a repetitive pattern of longitudinal positions of inner positioning mandrel 208 relative to engagement means 248 achievable upon longitudinal reciprocation of inner positioning mandrel 208 relative to engagement means 248. That repetitive pattern of positions is best illustrated with reference to FIG. 6 in which various positions of lug 326 are shown in phantom lines.

Beginning with one of the positions designated as 326A, which corresponds to a position in which upper annular wedge 316 has its wedging surface 320 engaged with locking surface 266 of the first plurality of positioner blocks 254 to lock them in their radially outward position so that their latch profile 274 is engaged with latch profile 202 in sliding sleeve 158 whereby the sliding sleeve may be moved downwardly within housing 142 to the closed position. Thus, positioner blocks 254 may be referred to as closing blocks 254. As is apparent in FIG. 6, in this first position 326A, the position is not defined by positive engagement of lug 326 with an extremity of J-slot 324, but rather the position is defined by the engagement of upper wedge 316 with positioner blocks 254.

Figure 6:
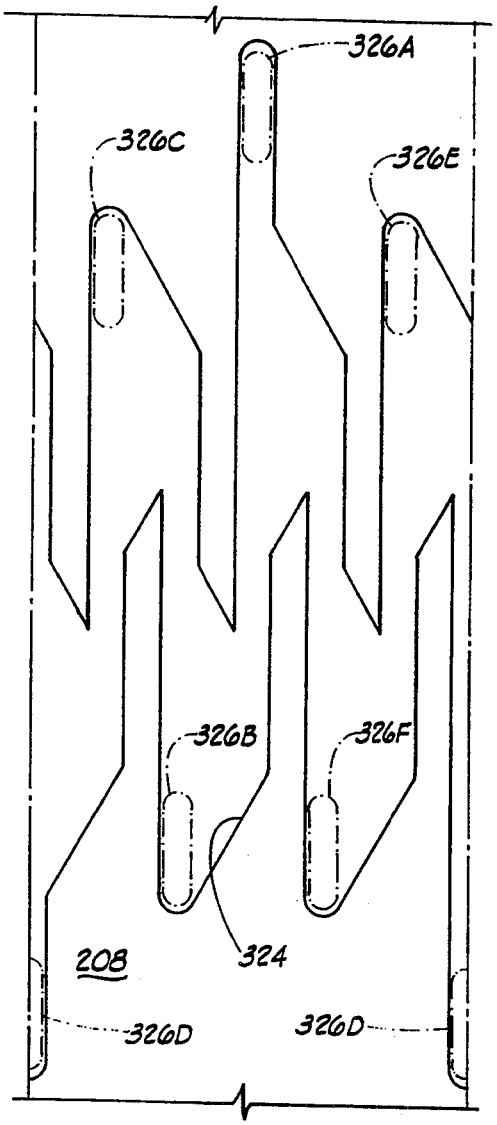
FIG. 6 is a laid-out view of a J-slot and lug in the positioner tool as shown along lines 6—6 in FIGS. 2F–2G.

By actuating opening cylinder section 78 and thereby pulling on tubing string 36 and inner positioning mandrel 208 upwardly, with engagement means 248 being held in place by the engagement of positioner block 254 with sliding sleeve 158 because of the outward biasing of positioner blocks 254 by springs 262, J-slot 324 will be moved upwardly so that lug 326 traverses downwardly and over to the position 326B as seen in FIG. 6. In position 326B, which can be referred to as an intermediate position, lug 326 is positively engaged with an extremity of J-slot 324 and allows engagement means 248 to be moved out of engagement with sliding sleeve 158 and upwardly in common with inner positioning mandrel 208.

The next downward stroke of inner positioning mandrel 208 relative to engagement means 248 moves lugs 326 to position 326C which is another intermediate position in which lug 326 is positively engaged with another extremity of J-slot 324 so that inner positioning mandrel 208 and engagement means 248 may be moved downwardly together through casing string 12 and casing valve 24.

On the next upward stroke of inner positioning mandrel 208 relative to engagement means 248, lug 326 moves to position 326D which is in fact defined by engagement of wedging surface 322 of lower annular wedge 318 with locking surface 296 on the lower set of positioner blocks 286 so that they are locked outwardly, with latch profile 304 thereof engaged with latch profile 202 and sliding sleeve 158, as best seen in FIGS. 2G and 2H. On this upward stroke, sliding sleeve 158 can be pulled up to its open position shown in FIGS. 2G–2I. Thus, positioner blocks 286 can also be referred to as opening blocks 286.

The next downward movement of inner positioning mandrel 208 relative to engagement means 248 moves lug 326 to position 326E which is in fact a repeat of position 326C insofar as the longitudinal position of inner positioning mandrel 208 relative to engagement means 248 is concerned.

The next position of inner positioning mandrel 208 moves lug 326 to position 326F which is a repeat of position 326B insofar as relative longitudinal position of inner positioning mandrel 208 relative to engagement means 248 is concerned.

Then, the next downward motion of inner positioning mandrel 208 relative to engagement means 248 moves lug 326 back to position 326A in which the upper wedge 316 will engage upper positioning blocks 254 to lock them radially outwardly such that latch profile 274 of positioner blocks 254 is again in operable engagement with latch profile 202 in sliding sleeve 158 of casing valve 24.

Positioner tool 44 further includes an emergency release means operatively associated with locking means 250 for releasing engagement means 248 from the locked position thereof without moving inner positioning mandrel 208. This emergency release means 352 includes first and second sets of shear pins 354 and 356 connecting upper and lower wedges 316 and 318, respectively, to inner positioning mandrel 208. Shear pins 354 and 356 are designed to shear when sufficient force is applied thereto for releasing positioner tool in the event that position control means 252 becomes disabled, as for example, by jamming of lug 326 in J-slot 324.

Jetting tool 50 can be generally described as an apparatus for hydraulically jetting a well tool, such as casing valve 24 disposed in well 11.

The construction of jetting tool 50 is very much associated with that of positioner tool 44. When positioner tool 44 engages sliding sleeve 158 in casing valve 24 and moves it to an open position, jetting tool 46 may then be appropriately aligned for hydraulically jetting through housing communication ports 148.

Jetting tool 50 can generally be described as a jetting means 50 connected to positioner tool 44 and forming a lower portion thereof. The primary components of jetting tool 50 include a jetting communication means 358 and an operating means 360.

Jetting communication means 358 includes a jetting adapter 362 which is attached to the lower end of lower guide adapter 236 of positioner tool 44 at threaded connection 364 with a sealing means, such as an O-ring 366, providing sealing engagement therebetween. A locking means, such as set screw 368, locks jetting adapter 362 to lower guide adapter 236.

Figure 8:
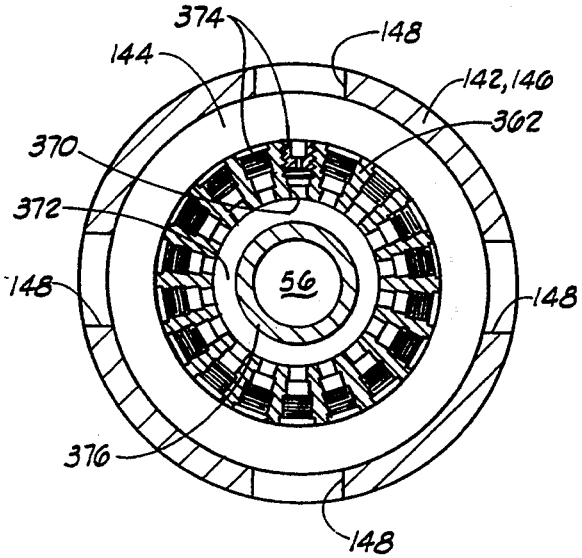
FIG. 8 is a cross-sectional view taken along lines 8—8 in FIG. 2I.

Referring to FIGS. 2I and 8, a plurality of angularly spaced, radially oriented jetting ports 370 are defined in jetting adapter 362 with an annulus 372 located radially inwardly from the jetting ports and in communication therewith. A plurality of replaceable jetting nozzles 374 are threadingly engaged with jetting adapter 362, and each jetting nozzle 374 is substantially aligned with a corresponding jetting port 370.

When jetting tool 50 is positioned in open casing valve 24 such that jetting nozzles 374 are longitudinally aligned with housing communication ports 148 in the casing valve, it is contemplated that at least one of jetting nozzles 374 will also be substantially radially aligned with each housing communication port 148 such that fluid jetted from that jetting nozzle will be directed outwardly of casing valve 24 through the corresponding housing communication port 148. This is accomplished because the number of jetting nozzles 374 is great enough to provide a broad jetting pattern insuring at least some such alignment. Thus, jetting tool 50 may be used to jet through casing valve 24 without any rotation of the tool string being necessary.

A jetting sleeve 376 is slidably disposed within lower guide adapter 236 and jetting adapter 362. Jetting sleeve 376 defines a plurality of transverse sleeve ports 378 therein which are in communication with central opening 56. Upon downward movement of jetting sleeve 376, sleeve ports 376 may be longitudinally aligned with annulus 372 and thus placed in communication with jetting ports 370 and jetting nozzles 374. An upper sealing means, such as O-ring 380, provides sealing engagement between lower guide adapter 236 and jetting sleeve 376 above annulus 372, and a lower sealing means, such as O-ring 382, provides sealing engagement between jetting adapter 362 and jetting sleeve 376 below annulus 372. Thus, when sleeve ports 378 are aligned with annulus 372, sealing is provided above and below sleeve ports 378 by O-rings 380 and 382, respectively.

Operating means 360 comprises a position control means 384 for controlling the longitudinal position of jetting sleeve 376 and a return means 386 for biasing the jetting sleeve in an upward direction.

Position control means 384 includes a J-slot 388, defined in jetting sleeve 376, and a lug 390 connected to jetting adapter 362, with the lug being received in the J-slot. Generally speaking, J-slot 388 can be said to be defined in one of jetting sleeve 376 and jetting adapter 362, with lug 390 being connected to the other of jetting sleeve 376 and jetting adapter 362. J-slot 388 can be defined in jetting adapter 362, with the lug being connected to jetting sleeve 376.

The lower end of jetting adapter 376 is attached to a spring housing 392 at threaded connection 394 and is locked in position therewith by locking means, such as a set screw 396.

The lower end of jetting sleeve 376 is attached to a spring plunger 398 at threaded connection 400. A sealing means, such as O-ring 402, provides sealing engagement between jetting sleeve 376 and spring plunger 398. Another sealing means, such as O-ring 404, provides sealing engagement between spring housing 392 and the lower end of jetting sleeve 376.

Lug 390 is mounted in a rotatable ring 406 sandwiched between jetting adapter 362 and the upper end of spring housing 392 with bearings 408 and 410 being located at the upper and lower ends, respectively, of rotatable ring 406. This permits lug 390 to rotate relative to J-slot 388 as jetting sleeve 376 is reciprocated or moved longitudinally relative to jetting adapter 362 so that lug 390 may traverse the endless J-slot 388.

Referring to FIG. 2J, the lower end of spring housing 392 is attached to a lower adapter 412 at threaded connection 414. A locking means, such as set screw 416, acts as a locking means for locking lower adapter 412 and spring housing 392 together.

Lower adapter 412 defines a bore 418 therethrough, and the lower end of spring plunger 398 is slidably disposed in bore 418.

Spring plunger 398 has a radially outwardly extending flange 420 thereon, and the upward movement of spring plunger 398, and thus of jetting sleeve 376, is limited by engagement of flange 420 with a downwardly facing shoulder 422 in spring housing 392.

Flange 420 has a downwardly facing shoulder 424 thereon which is generally opposite upper end 426 of lower adapter 412. It will be seen that an annulus 428 is defined radially between spring plunger 398 and spring housing 392 and longitudinally between shoulder 424 and upper end 426. A housing port 430 is defined in spring housing 392 and provides communication between annulus 428 and the well annulus outside jetting tool 50.

Return means 386 of operating means 360 further includes a biasing means, such as spring 432, which is disposed in annulus 428 for upwardly biasing flange 420 of spring plunger 398 toward shoulder 422 in spring housing 392.

J-slot 388 and lug 390 of position control means 384 interconnect jetting sleeve 376 and jetting adapter 362 and define at least in part a repetitive pattern of longitudinal positions of jetting sleeve 376 relative to jetting adapter 362 upon longitudinal reciprocation of jetting sleeve 376 relative to jetting adapter 362. This repetitive pattern of positions is best illustrated with reference to FIG. 7 in which various positions of lug 390 are shown in phantom lines.

Beginning with one of the positions designated as 390A, that position corresponds to the closed jetting position of jetting sleeve 376 illustrated in FIGS. 2H and 2I, wherein sleeve ports 378 are spaced upwardly from annulus 372 and therefore not in communication therewith.

Figure 7:
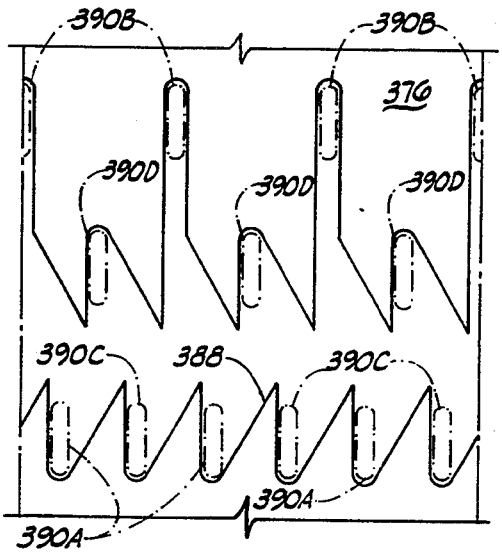
FIG. 7 is a laid-out view of a J-slot and lug in the jetting tool and taken along lines 7—7 in FIG. 2I.

By applying pressure to central opening 56, as further described herein, jetting sleeve 376, and thus J-slot 388, will be moved downwardly with respect to lug 390 so that lug 390 traverses relatively upwardly and over to the position 390B shown in FIG. 7. In position 390B, which can be referred to as an open jetting position, lug 390 is positively engaged with an extremity of J-slot 388 and jetting nozzles 374 are longitudinally aligned with housing communication ports 158 in housing 142 of casing valve 24.

As pressure is relieved, spring 432 forces jetting sleeve 376 back upwardly relative to jetting adapter 362 such that lug 390 is moved to position 390C which is again a closed jetting position for jetting means 50.

Another repressurization of central opening 56 will result in jetting sleeve 376 being moved downwardly until lug 390 is in position 390D. This is also a closed position of the jetting means and may be referred to as a "blanked-off" position. This position allows pressurization of central opening 56 for purposes of actuating hydraulic slips 62 of hold-down section 46 and actuation of operating cylinder section 48 without opening of jetting tool 50.

If pressure is again relieved in central opening 56, spring 432 biases jetting sleeve 376 upwardly so that lug 390 is returned to position 390A, thus repositioning jetting tool 50 for another cycle.

OPERATION OF THE INVENTION

Use of casing valves such as 24, 26 and 28 along with the tool string shown in FIGS. 2A–2J provides a system for the completion of highly deviated wells which substantially reduce completion costs in such wells by eliminating perforating operations, and by eliminating the need for establishing zonal isolation through the use of packers and bridge plugs. In general, this system will provide substantial savings in rig time incurred during completion of the trial. The tool string is adapted for use on coiled tubing and manipulation thereof is minimized. Another advantage of using the apparatus in operation with a coiled tubing unit is that it may not be necessary to have a rig over the hole.

The operation of the invention is described herein as relating to wells that have the production string containing casing valves 24, 26 and 28 cemented in place. However, it should be understood that the invention is not necessarily so limited. The casing valves may also be used in uncemented completions wherein zonal isolation between the casing valves is established by external casing packers or the like. Also, the casing valves may be used in any cemented/uncemented combination.

Completion of well 11 utilizing system 10 begins with the cementing of production casing string 12 into well bore 14 with cement as indicated at 16. Particularly, well 11 is cemented across the zones of interest in which casing valves, such as 24, 26 and 28, have been located prior to running casing string 12 into the well. With this system, a casing valve is isolated at each point in which well 11 is to be stimulated adjacent to some subsurface formation interest such as the subsurface formations 30, 32 and 34. These points of interest have been previously determined based upon logs of the well and other reservoir analysis data. Casing string or liner string 12 containing the appropriate number of casing valves 24 is centralized and cemented in place within well bore 14 utilizing acceptable practices for cementing in horizontal hole applications.

After cementing, a bit and stabilizer trip should be made to clean and remove as much as possible the residual cement lying on the bottom of casing string 12 in horizontal section 22. The bit size utilized should be the largest diameter bit that can be passed safely through casing string 12. After cleaning out to the total depth of the well by drilling out residual cement, the fluid in casing string 12 should be changed over to a filtered clear completion fluid suitable for use in completing the well if this has not already been done when displacing the final cement plug during the cementing process.

The next trip into the well is with tool string 36 of FIGS. 2A–2J, including positioner tool 44, hold-down section 46, operating cylinder section 48 and jetting tool 50, as is schematically illustrated in FIG. 1. In FIG. 1, the tool assembly is shown as it is being lowered into vertical portion 18 of well 11. The tool assembly will pass through radiused portion 20 and into deviated portion 22 of well 11. The tool assembly should first be run to just below the lowermost casing valve 28 and then reciprocated upwardly through casing valve 28 until lower positioner blocks 286 are aligned with sliding sleeve 158 in the casing valve such that latch profile 304 on positioner blocks 286 is engaged with profile 202 in sliding sleeve 158.

It is noted that when the terms "upward" or "downward" are used in the context of direction or movement in the well, these terms are used to mean movement along the axis of the well either uphole or downhole, respectively, which in many cases will not be exactly vertical and can in fact be horizontal, such as in horizontal portion 22 of deviated well 11.

An upward pull on the tubing string then results in the extension of opening cylinder section 78 and closing cylinder section 80 of operating cylinder section 48. At this point, pressure is applied to the coiled tubing of tubing string 36 and thus to central opening 56. If lug 390 of position control means 384 in jetting tool 50 is in closed position 390A, as shown in FIG. 7, this pressurization will result in jetting sleeve 376 being forced downwardly to an open position in which ports 378 therein are aligned with annulus 372 and jetting nozzles 374. Thus, flow is initiated through the jets, but this pressure will be bled off through jetting nozzles 374 to allow jetting sleeve 376 to index to the next closed position thereof corresponding to lug position 390C, at which time pressure may be reapplied. Regardless of whether jetting sleeve 376 is cycled as just described or whether it is originally in the closed position corresponding to lug position 390C, the repressurization will result in jetting sleeve 376 being moved to the blanked-off position 390D of lug 390, wherein ports 378 in jetting sleeve 376 are not in communication with jetting nozzles 374 so that no jetting occurs and there is no pressure bleed-off.

At this point, as the pressure is applied, hydraulic hold-down portion 46 or 46' is actuated so that hydraulic slips 62 or 62' are forced radially outwardly by pressure applied thereto until they lockingly engage casing bore 17 or 17' in well casing 12 or 12'. Hydraulic hold-down section 46 or 46' thus holds the tubing string longitudinally within well bore 12 or 12'. Hydraulic slips 62 or 62' are inherently designed, or are appropriately installed in hold-down portion 46 or 46', such that the slips will grip well casing 12 or 12' from either longitudinal direction and thus will hold forces applied thereto either upwardly or downwardly when actuated.

Since both opening cylinder section 78 and closing cylinder section 80 are extended, the closing cylinder section is, in effect, deactivated. Pressure applied to central opening 56 in the tool will act across the differential area in opening cylinder section 78 to generate an upward force on opening cylinder 94 which results in an upward force on the rest of the tool. Once the pressure reaches a sufficient level, operating means 210 is actuated. That is, an upward pull is applied to inner positioning mandrel 208 such that lower positioner blocks 286 of engagement means 248 are raised upwardly to move sliding sleeve 158 to its open position as illustrated in FIGS. 2G–2I.

Once sliding sleeve 158 has been opened, and if it is desired at this point to activate jetting tool 50, pressure is released in the coiled tubing, and thus in central opening 56 of the tool, to allow jetting sleeve 376 to be returned to the closed position corresponding to position 390A of lug 390 in J-slot 388. Of course, when the pressure is relieved, spring 432 of return means 386 forces jetting sleeve 376 back upwardly to this position. Once the pressure has been relieved in the coiled tubing, tool string 36 is retensioned to remove any slack resulting from the opening of sliding sleeve 158 in casing valve 28.

The tubing string and central opening 56 are then repressurized. During this pressure cycle, jetting sleeve 376 is again moved to its open position so that fluid pressure in central opening 56 is communicated to jetting nozzles 374 through ports 378 in jetting sleeve 376, annulus 372 and jetting ports 370 in jetting adapter 362. Jetting may then be carried out in a normal manner to remove any cement in housing communication ports 148 in the casing valve as well as to notch the cement sheath adjacent to the ports for fracture initiation.

If fracturing is to immediately follow, without jetting any other casing valves, casing valve 28 may be left in the open position and tool string 36 withdrawn from the well once pressure has been relieved to retract hydraulic slips 62 or 62' in hold-down section 46 or 46'.

To close sliding sleeve 158 in the casing valve, positioning means 48 is positioned immediately above the casing valve to be closed and then reciprocated downwardly through the casing valve until upper positioner blocks 254 are positioned adjacent to sliding sleeve 158 such that latch profile 274 in the positioner blocks is aligned with, and engages, latch profile 202 in sliding sleeve 158.

At this point, a downward force is applied to tubing string 36 to collapse opening cylinder section 78 and closing cylinder section 80 of operating cylinder section 48. Pressure is then applied to tubing string 36.

As in the opening sequence described above, if jetting sleeve 376 is in the closed position corresponding to lug position 390A when pressure is applied, the pressure will force jetting sleeve 376 to an open position corresponding to lug position 390B. In this case, pressure must be relieved to index jetting sleeve 376 back to the closed position corresponding to lug position 390C as previously described. Pressure may then be reapplied so that jetting sleeve 376 moves to the blanked-off position corresponding to lug position 390D. In other words, no fluid is supplied to jetting nozzles 374.

Since opening cylinder section 78 and closing cylinder section 80 are collapsed, opening cylinder section 78 is, in effect, deactivated. The pressure applied in central opening of tool 10 acts across the differential area in closing cylinder section 80 to generate a downward force on closing piston 134 which imparts a downward force on inner positioning mandrel 208 in positioner tool 44. This results in engagement means 248 being locked into engagement with sliding sleeve 158 in the casing valve so that operating means 210 is moved downwardly to close sliding sleeve 158 once sufficient pressure has been applied.

Once sliding sleeve 158 in the casing valve has been closed, pressure in tubing string 36 may be relieved to retract hydraulic slips 62 or 62' in hold-down section 46 or 46' so that the tubing string may be withdrawn from well casing 12 or 12' or repositioned at another casing valve, such as casing valves 24 and 26.

It will be seen, therefore, that the completion tool system of the present invention is well adapted to carry out the ends and advantages mentioned, as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. An apparatus for actuating a sliding member of a well tool, said apparatus comprising:

an inner mandrel;

operating means for selectively operably engaging the sliding member of the well tool in response to longitudinally reciprocating motion of said inner mandrel, said operating means comprising radially outwardly biased engagement means for automatically engaging the sliding member of the well tool when aligned therewith and for longitudinally actuating said sliding member in response to further longitudinally reciprocating motion of said inner mandrel; and hydraulic actuating means for providing said reciprocating motion of said inner mandrel in response to a fluid pressure in said inner mandrel.

2. The apparatus of claim 1 further comprising hold-down means for lockingly engaging a well bore when said hydraulic actuating means is pressurized.

3. The apparatus of claim 2 wherein said hydraulic hold-down means comprises a plurality of hydraulic slips actuated by pressure applied thereto.

4. The apparatus of claim 3 wherein said hydraulic slips are adapted for lockingly engaging said well bore against both upward and downward forces applied to the apparatus.

5. The apparatus of claim 3 wherein:

said well bore defines a notch therein; and said hydraulic slips have a lug extending therefrom, said lug being adapted for engagement with said notch when said hydraulic slips are actuated.

6. The apparatus of claim 1 wherein said hydraulic actuating means comprises an opening cylinder for providing an upward force on said inner mandrel when pressure is applied to said opening cylinder.

7. The apparatus of claim 6 wherein:

said opening cylinder is slidably disposed on a piston; and said opening cylinder is moved upwardly with respect to said piston when pressure is applied to said opening cylinder.

8. The apparatus of claim 1 wherein said hydraulic actuating means comprises a closing cylinder for providing a downward force on said inner mandrel when pressure is applied to said closing cylinder.

9. The apparatus of claim 1 wherein said engagement means comprises:

a plurality of positioner blocks circumferentially spaced around a longitudinal axis of said inner mandrel and having a radially outwardly facing engagement surface thereon; and biasing means for biasing said positioner blocks radially outwardly from said longitudinal axis.

10. The apparatus of claim 9 wherein each of said positioner blocks has a tapered locking surface defined on an end thereof.

11. The apparatus of claim 10 wherein said plurality of positioner blocks is a first plurality of positioner blocks; and further comprising:

a second plurality of positioner blocks circumferentially spaced about said longitudinal axis, each of the second positioner blocks having a radially outwardly facing engagement surface thereon; and a second biasing means for resiliently biasing said second positioner blocks radially outwardly from said longitudinal axis.

12. The apparatus of claim 1 wherein said operating means further comprises:

locking means, connected to said inner mandrel, for locking said engagement means in operable engagement with the sliding member; and position control means, operably associated with said inner mandrel, for permitting said inner mandrel to reciprocate longitudinally and selectively lock and unlock said engagement means with said locking means.

13. The apparatus of claim 12 wherein said engagement means comprises:

a plurality of positioner blocks circumferentially spaced around a longitudinal axis of said inner mandrel and having a radially outwardly facing engagement surface thereon; and biasing means for biasing said positioner blocks radially outwardly from said longitudinal axis.

14. The apparatus of claim 13 wherein each of said positioner blocks has a tapered locking surface defined on an end thereof.

15. The apparatus of claim 14 wherein said locking means includes an annular wedge having a tapered annular locking surface complementary to said locking surface of said positioner blocks, said annular wedge being positioned on said inner mandrel so that when said inner mandrel is moved to a first longitudinal position, said annular wedging surface wedges against said tapered locking surfaces and locks said positioner blocks radially outwardly.

16. The apparatus of claim 15 wherein said plurality of positioner blocks is a first plurality of positioner blocks; and further comprising:

a second plurality of positioner blocks circumferentially spaced around said longitudinal axis, each of the second blocks having a radially outwardly facing engagement surface thereon; and a second biasing means for resiliently biasing said second plurality of engagement blocks radially outwardly from said longitudinal axis.

17. The apparatus of claim 16 wherein said second plurality of engagement blocks defines a tapered locking surface on an end thereof.

18. The apparatus of claim 17 wherein said locking means further comprises a second annular wedge having a tapered annular locking surface complementary to said tapered locking surfaces of said second plurality of engagement locks; and said tapered annular locking surfaces of said first and second wedges face toward one another with said first and second plurality of engagement blocks being located between said first and second annular wedges.

19. The apparatus of claim 16 wherein said engagement surface defines at least in part a selective latch profile adapted for matching engagement with a corresponding latching profile in the sliding member of the well tool.

20. The apparatus of claim 19 wherein said engagement surface is one of a pair of spaced engagement surfaces defining a groove therebetween.

21. The apparatus of claim 13 further comprising a sleeve between said inner mandrel and said biasing means.

22. An apparatus for positioning a sliding member of a well tool, said apparatus comprising:

an inner mandrel;

operating means for selectively operably engaging the sliding member of the well tool in response to longitudinally reciprocating motion of said inner mandrel, said operating means comprising radially outwardly biased engagement means for automatically engaging the sliding member of the well tool when aligned therewith;

hydraulic actuating means for providing said reciprocating motion of said inner mandrel in response to a fluid pressure in said inner mandrel; and a jetting tool for jetting fluid through a port defined in the well tool when said sliding member of said well tool is in an open position.

23. The apparatus of claim 22 wherein said jetting tool comprises:

a jetting adapter defining a jetting port therein;

a jetting sleeve slidably disposed in said jetting adapter, said jetting sleeve defining a sleeve central opening therein; and jetting operating means for longitudinally moving said jetting sleeve as pressure is applied thereto such that said jetting sleeve may be selectively moved between a closed position and an open position in which pressure in sleeve central opening is in communication with said jetting port.

24. The apparatus of claim 23 wherein:

said jetting sleeve defines a sleeve port therein in communication with said sleeve central opening; and said sleeve port is in communication with said jetting port when said sleeve is in said open position.

25. The apparatus of claim 23 wherein:

said sleeve moves in one longitudinal direction in response to pressure applied thereto; and further comprising return means for biasing said jetting sleeve in an opposite direction from said one direction.

26. The apparatus of claim 25 wherein said return means comprises a spring.

27. The apparatus of claim 23 wherein said jetting operating means comprises a position control means for controlling a longitudinal position of said jetting sleeve.

28. The apparatus of claim 27 wherein said position control means is characterized by a J-slot engaged by a lug.

29. The apparatus of claim 27 wherein said position control means defines:

a closed position corresponding to said closed position of said jetting sleeve;

an open position corresponding to said open position of said jetting sleeve; and a blanked-off position corresponding to another closed position of said jetting sleeve such that said hydraulic actuating means may be actuated without bleeding pressure through said jetting port.

30. A downhole tool apparatus comprising:

a casing valve comprising:

an outer housing positionable in a casing string of a well, said outer housing defining a longitudinal passageway therethrough and having a side wall defining a housing communication port therethrough; and a sleeve slidably disposed in said longitudinal passageway and being selectively movable to said housing between a closed position blocking said housing communication port and an open position wherein said housing communication port is communicated with said longitudinal passageway, said sliding sleeve defining a selective latch profile therein;

a positioner tool comprising:

an inner mandrel longitudinally movable relative to said casing valve; and operating means having a latching profile thereon for engaging said latching profile in said sliding sleeve and thereby moving said sliding sleeve between open and closed positions thereof; and an operating cylinder comprising:

an opening cylinder section for actuating said inner mandrel and thereby moving said operating means such that said sliding sleeve is moved to said open position in response to pressure in said inner mandrel; and a closing cylinder section for actuating said inner mandrel and moving said operating means such that said sliding sleeve is moved to said closed position in response to a pressure in said inner mandrel.

31. The apparatus of claim 30 wherein:

said opening cylinder section provides an upward force on said inner mandrel; and said closing cylinder section provides a downward force on said inner mandrel.

32. The apparatus of claim 30 further comprising hold-down means for lockingly engaging an inner surface of said well in response to a pressure in said inner mandrel and prior to actuation of said opening cylinder section and said closing cylinder section.

33. The apparatus of claim 32 wherein:

said inner surface of said well defines a notch therein; and said hydraulic hold-down means comprises a hydraulic slip having a lug extending therefrom and adapted for engagement with said notch for preventing longitudinal movement of said hydraulic hold-down means.

34. The apparatus of claim 30 further comprising a jetting tool movable between open and closed positions thereof in response to a pressure in said inner mandrel, said jetting tool comprising jetting means for jetting fluid through said housing communication port when said housing communication port and said jetting tool are in said open positions thereof.

35. An apparatus for hydraulically jetting a well tool disposed in a well, said well tool having a sliding member and further defining a communication port through a side wall thereof, said apparatus comprising:

a jetting adapter;

a jetting nozzle connected to said jetting adapter;

a jetting sleeve slidably disposed in said jetting adapter and defining a sleeve central opening therethrough, said jetting sleeve having an open position wherein said sleeve central opening is in fluid communication with said jetting nozzle; and operating means for substantially aligning said jetting nozzle with the communication port in said well tool and positioning said jetting sleeve in said open position such that fluid in said sleeve central opening is jetting through said jetting nozzle into said communication port.

36. The apparatus of claim 35 further comprising return means for biasing said jetting sleeve toward said closed position thereof.

37. The apparatus of claim 36 wherein said return means is characterized by a spring providing an upward force on said jetting sleeve.

38. The apparatus of claim 35 wherein said operating means comprises a position control means for controlling a longitudinal position of said jetting sleeve corresponding to said open and closed positions thereof.

39. The apparatus of claim 38 wherein said position control means is characterized by a J-slot engaged by a lug.

40. The apparatus of claim 35 wherein said jetting sleeve defines a sleeve port therein in communication with said sleeve central opening, said sleeve port being substantially aligned with said jetting nozzle when said jetting sleeve is in said open position.

* * * * *